US008128505B2

(12) United States Patent
Tryner et al.

(10) Patent No.: US 8,128,505 B2
(45) Date of Patent: Mar. 6, 2012

(54) GOLF PUTTER HEAD INCLUDING A CANTILEVERED ALIGNMENT AID

(75) Inventors: Andrew K. Tryner, Chicago, IL (US); Douglas J. Thiel, Streamwood, IL (US); Robert T. Thurman, Plainfield, IL (US); Jon C. Pergande, Arlington Heights, IL (US)

(73) Assignee: Wilson Sporting Goods, Chicago, IL (US)

( * ) Notice: Subject to any disclaimer, the term of this patent is extended or adjusted under 35 U.S.C. 154(b) by 36 days.

(21) Appl. No.: 12/779,148

(22) Filed: May 13, 2010

(65) Prior Publication Data

US 2011/0224014 A1 Sep. 15, 2011

Related U.S. Application Data

(60) Provisional application No. 61/313,581, filed on Mar. 12, 2010.

(51) Int. Cl.
*A63B 69/36* (2006.01)
*A63B 53/04* (2006.01)

(52) U.S. Cl. ..... 473/242; 473/251; 473/253; 473/254; 473/340

(58) Field of Classification Search ..... 473/219–256, 473/340–341; D21/736–746, 759
See application file for complete search history.

(56) References Cited

U.S. PATENT DOCUMENTS

| | | | | |
|---|---|---|---|---|
| 2,822,614 A | | 2/1958 | Susinno | |
| 2,929,631 A | | 3/1960 | Gillon | |
| 3,019,022 A | | 1/1962 | Ehmke | |
| 3,043,596 A | | 7/1962 | Ehmke | |
| 3,880,430 A | | 4/1975 | McCabe | 273/183 |
| D235,668 S | * | 7/1975 | Swash | D21/739 |
| 4,136,877 A | | 1/1979 | Antonious | 273/164 |
| 4,367,877 A | | 1/1983 | Gibson et al. | 273/164 |
| 4,458,900 A | | 7/1984 | Antonious | 273/164 |
| 4,519,612 A | | 5/1985 | Tsao | 273/163 |
| 4,712,798 A | | 12/1987 | Preato | 273/164 |
| 4,749,196 A | | 6/1988 | Podgor | 273/164 |
| 4,919,424 A | | 4/1990 | Fukumochi et al. | 273/164 |
| 4,986,544 A | | 1/1991 | Benson | 273/183 |
| D325,414 S | | 4/1992 | Woolsey | |
| 5,351,963 A | | 10/1994 | Baek | 273/187.4 |
| 5,433,444 A | | 7/1995 | Chiuminatta et al. | 273/164.1 |
| 5,538,249 A | * | 7/1996 | Benson | 473/254 |
| 5,640,777 A | | 6/1997 | Densberger et al. | 33/263 |
| 5,893,804 A | | 4/1999 | Pan | 473/240 |
| 5,921,868 A | | 7/1999 | DiMartino | 473/254 |
| 6,062,986 A | | 5/2000 | Kaise | 473/242 |

(Continued)

*Primary Examiner* — Sebastiano Passaniti
(74) *Attorney, Agent, or Firm* — Terence P. O'Brien

(57) ABSTRACT

A putter head including a fore body and an aft body. The fore body includes a planar front strike face, heel and toe side walls, a rear wall, a top surface and a generally planar sole. The top surface includes a sight line. The sight line extends along a first plane that is perpendicular to the strike face and to the sole, and is substantially evenly spaced from the heel and toe side walls. The aft body is coupled to the fore body and includes a rear main portion and an overhang. The rear main portion is engaged to the rear wall of the fore body, and has a central region positioned between first and second end regions. The overhang forwardly extends from the central region. The overhang includes an elongate slot extending along the first plane, and is positioned over at least a portion of the sight line.

31 Claims, 7 Drawing Sheets

U.S. PATENT DOCUMENTS

| | | | | |
|---|---|---|---|---|
| 6,319,146 | B1 * | 11/2001 | Mills | 473/244 |
| RE37,519 | E | 1/2002 | Densberger et al. | 33/263 |
| 6,758,760 | B1 | 7/2004 | Kellogg et al. | 473/220 |
| D494,239 | S | 8/2004 | Green | D21/742 |
| 6,860,822 | B2 | 3/2005 | Vrska, Jr. | 473/324 |
| 7,052,409 | B2 | 5/2006 | Goldsmith | 473/242 |
| D531,242 | S * | 10/2006 | Adams | D21/746 |
| 7,134,966 | B1 | 11/2006 | Tice | 473/220 |
| D537,137 | S * | 2/2007 | Sheehan | D21/746 |
| D565,139 | S * | 3/2008 | Wilson | D21/743 |
| 7,387,576 | B2 | 6/2008 | Agnew | 473/240 |
| D587,771 | S * | 3/2009 | Kuan et al. | D21/759 |
| D603,008 | S * | 10/2009 | Donahue | D21/742 |
| 7,611,419 | B2 * | 11/2009 | O'Neill | 473/242 |
| 7,766,762 | B2 * | 8/2010 | Stellander | 473/251 |
| D623,710 | S * | 9/2010 | Hilton et al. | D21/743 |
| D625,764 | S * | 10/2010 | Hilton et al. | D21/743 |
| D633,968 | S * | 3/2011 | Tryner et al. | D21/759 |
| D633,969 | S * | 3/2011 | Tryner et al. | D21/759 |
| D637,674 | S * | 5/2011 | Tryner et al. | D21/759 |
| 2004/0092327 | A1 | 5/2004 | Marnocha | 473/220 |
| 2005/0020372 | A1 | 1/2005 | Hermle et al. | 473/242 |
| 2006/0094522 | A1 * | 5/2006 | Tang et al. | 473/251 |
| 2006/0135277 | A1 | 6/2006 | Marnocha | 473/220 |
| 2006/0229137 | A1 * | 10/2006 | McCarthy | 473/251 |
| 2007/0191130 | A1 * | 8/2007 | Kouldus | 473/251 |

* cited by examiner

FIG. 4
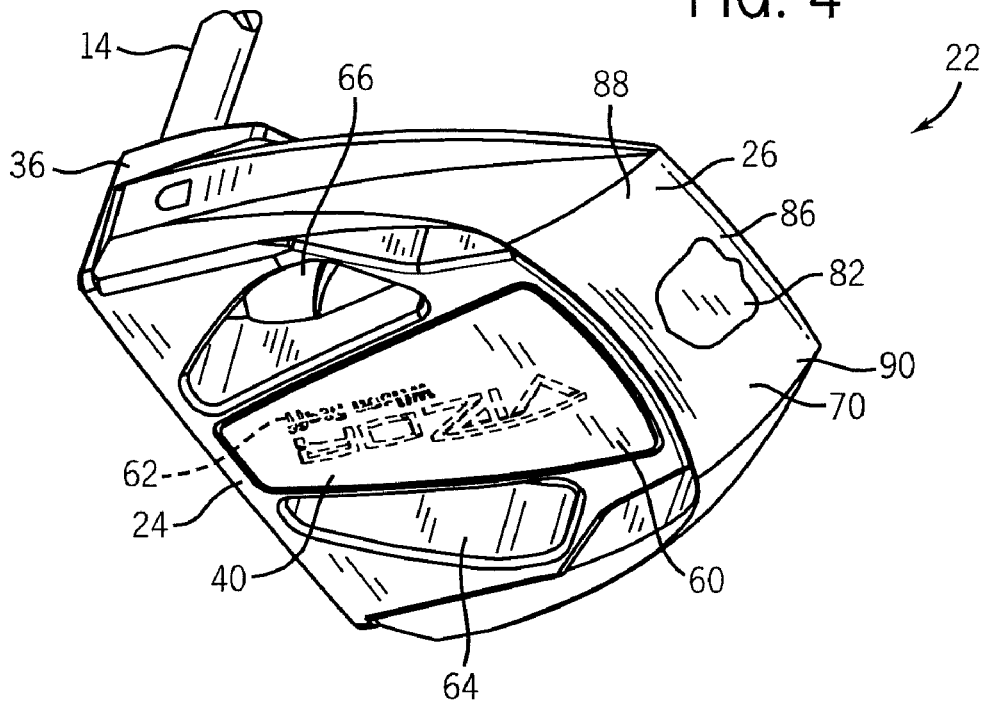
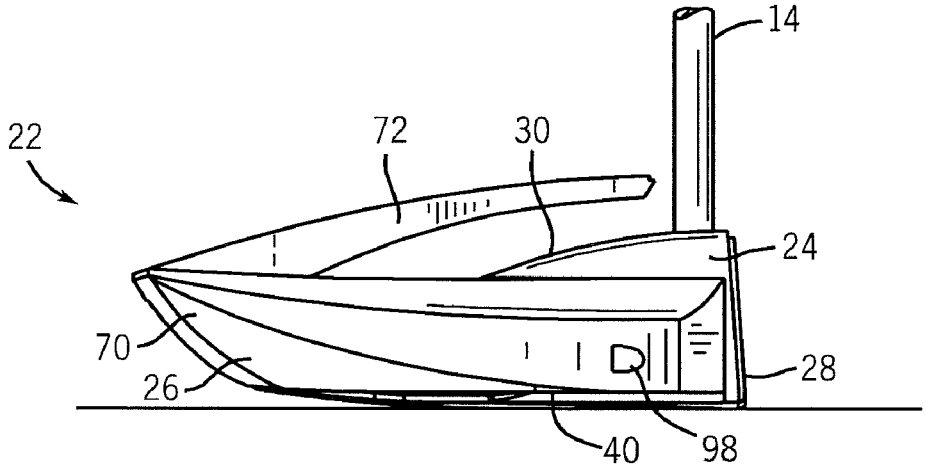
FIG. 5

GOLF PUTTER HEAD INCLUDING A CANTILEVERED ALIGNMENT AID

RELATED U.S. APPLICATION DATA

The present invention claims the benefit of the filing date under 35 U.S.C. §119(e) of U.S. Provisional Patent Application Ser. No. 61/313,581, filed on Mar. 12, 2010, which is hereby incorporated by reference in its entirety.

FIELD OF THE INVENTION

The present invention relates generally to a club head for a golf club. In particular, the present invention relates to a head of a putter including a cantilevered alignment aid.

BACKGROUND OF THE INVENTION

Of all the clubs used by golfers during a round: drivers, irons, wedges, hybrids and putters; the putter is the club that is used the most. In one Industry study, putting accounting for over 43 percent of the average golfer's strokes during a round of golf. See Science and Golf, Proceedings of the World Scientific Congress of Golf, "An Analysis of Eye and Club Face Alignment at Address in Putting" by James MacKay, OnePutt Enterprises, Inc. Accordingly, the putter is the most often used club in most golfer's bags.

Teaching professionals generally say that the best way to improve a golfer's score is to improve his or her short game, and the best way to improve a golfer's short game is to improve his or her putting. Putting well requires a putting stroke that is repeatable and consistent. The putting stroke may seem like the simplest swing in golf to perform, but many golfers struggle to perform the task consistently and successfully. Generally accepted putting practice calls for the golfer to position his or her eyes directly over the line of the putt (the aim line) and slightly behind the ball to maximize the golfer's ability to contact the golf ball cleanly and accurately. When a golfer's eyes are directly over the line of the putt, the resulting alignment angle is 0 degrees. Increasing the consistency of the golfer's eye position over the intended target line increases the likelihood that the putter will roll more putts on line and yield a higher percentage of holed putts. However, if a golfer places his or her eyes inside or outside of the aim line of putt, undesirable alignment angles result, which can lead to pushed or pulled putts. The failure of a putter to consistently align his or her eyes over the target line leads to difficulty in hitting puts on a consistent line, and therefore adds more strokes to a golfer's round due to failed putt attempts. Such incorrect alignment is common for many golfers and not easy to self-diagnose. Many golfers do not realize that their alignment angle is off target until a teaching professional or experienced golfer identifies the alignment flaw.

Existing putters typically include some form of a sight line on the upper surface of the putter for assisting the alignment of the strike surface of the putter with the golf ball. Sightlines vary in length, width, shape and style, but typically do not assist a golfer in properly aligning his or her eyes over the putter and the target line of the putt. Further, many existing putters provide poor weight distribution which can lead to inadvertent and undesirable shifting or misalignment of the strike face of the putter during the putting stroke, which can also lead to missed putts and/or pushed or pulled putts.

Thus, a continuing need exists for a golf putter that provides the golfer with an alignment aid to assist the golfer in aligning his or her eyes over the putter and the target line of the putt. It would be beneficial to provide a putter that enables a golfer to properly position his or her eyes over the putter and the target line of the ball without requiring instruction and guidance from a teaching professional or other experienced golfers. What is also needed is a putter that includes an alignment aid for assisting in proper alignment and an optimal weight distribution to reduce the likelihood of a golfer inadvertently shifting or moving the strike face of the putter during the putt stroke. Further, a continuing need also exists to produce a putter with an improved, engaging aesthetic.

SUMMARY OF THE INVENTION

The present invention provides a putter head for a golf club. The putter head includes a fore body coupled to an aft body. The fore body includes a planar front strike face, a heel side wall, a toe side wall, a rear wall, a top surface and a generally planar sole. The top surface includes a sightline. The sightline extends along a first plane that is perpendicular to the front strike face and to the sole, and substantially evenly spaced from the heel and toe side walls. The aft body includes a rear main portion and an overhang. The rear main portion is engaged to the rear wall of the fore body, and has a central region positioned between first and second end regions. The overhang forwardly extends from the central region of the main portion. The overhang includes an elongate slot extending along the first plane, and positioned substantially over at least a portion of the sightline.

According to a principal aspect of a preferred form of the invention, a putter head configured for placement onto a substantially horizontal surface includes a front wall, a rear portion, a base and an overhang. The front wall has a planar front strike face. The base rearwardly extends from the front wall to the rear portion. The base has a central region and includes a sightline. The overhang forwardly extends from the rear portion and over the central portion of the base toward the front wall. The overhang contacts only the rear portion of the putter head. The overhang includes an elongate slot. The slot is positioned such that, when the putter head is placed onto the horizontal surface with the base contacting the surface, the slot extends over a majority of the surface area of the sightline.

This invention will become more fully understood from the following detailed description, taken in conjunction with the accompanying drawings described herein below, and wherein like reference numerals refer to like parts.

BRIEF DESCRIPTION OF THE DRAWINGS

FIG. 4 is a bottom, rear perspective view of the putter head of FIG. 1.

FIG. 5 is a side view of the putter head of FIG. 1.

DETAILED DESCRIPTION OF THE PREFERRED EMBODIMENTS

Figure 1:
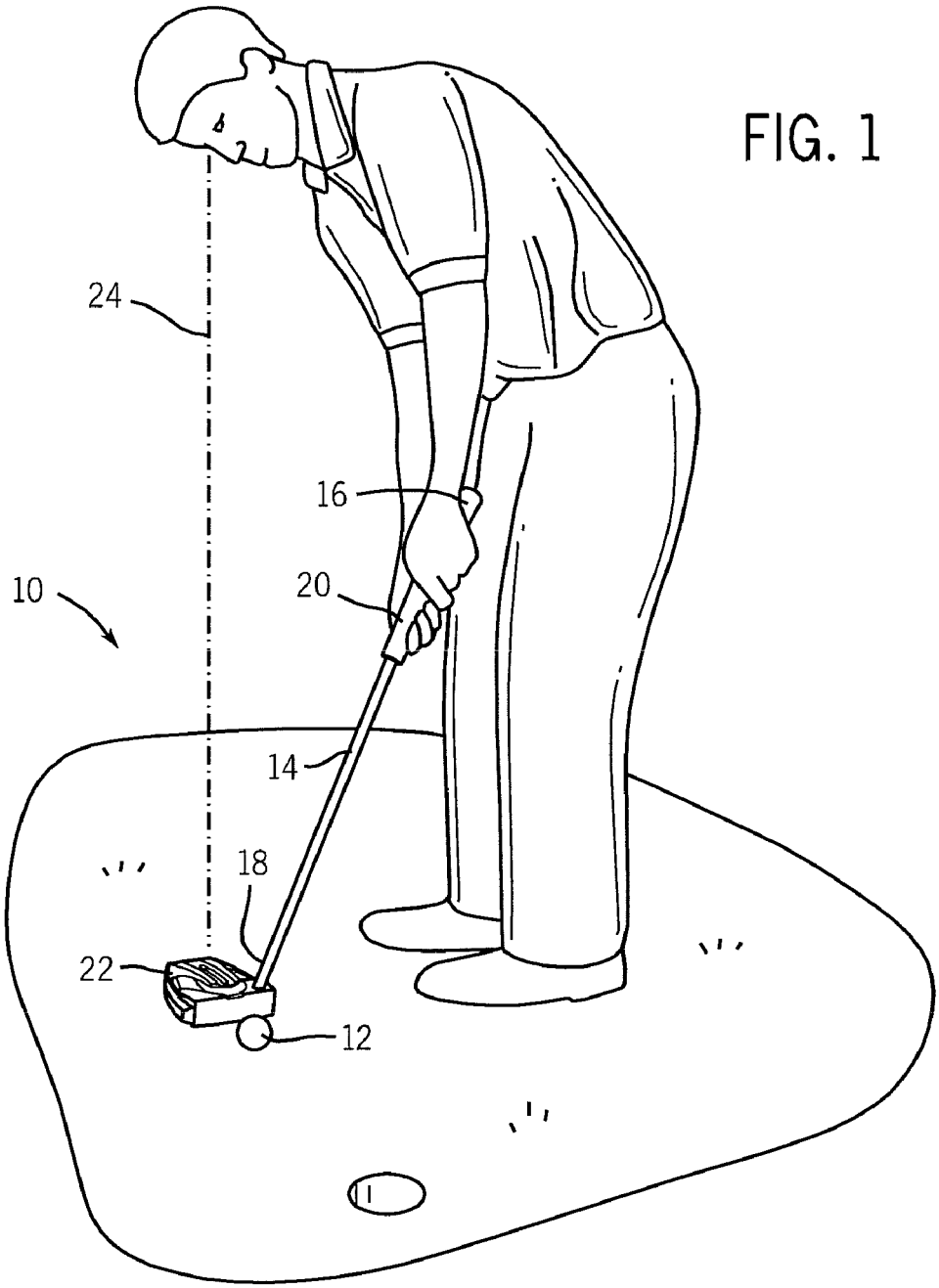
FIG. 1 is an image of a golfer putting with a putter having a putter head in accordance with a preferred embodiment of the present invention.

Referring to FIG. 1, a putter is indicated generally at 10. The putter 10 is an elongate implement configured for stroking or putting a golf ball 12 and includes a golf shaft 14 having a butt end 16 and a tip end 18, a grip 20 coupled to the butt end 16, and a putter club head 22 (or putter head) coupled to the tip end 18. The putter 10 of the preferred embodiment is configured for use by a right-handed golfer. The putter can be also be configured for use by a left-handed golfer. The present invention facilitates the golfer's ability to properly align himself or herself over the club head 22 prior to and during the execution of a putting stroke. Axis 24 is vertically aligned to indicate that the eyes of the golfer are properly aligned over the club head 22.

The club head 22 is a generally planar body that is coupled to the shaft 14. Preferably, the club head 22 is affixed to the shaft 14 with an epoxy adhesive. A ferrule (not shown) can be used to generally cover a portion of the connection of the club head 22 to the shaft 14. The club head 22 is typically formed of a high tensile strength, durable material, preferably stainless steel. Alternatively, the club head 20 can be formed of other materials such as, for example, other metals, alloys, ceramics, fiber composite materials, wood, thermoset polymers, thermoplastic polymers or combinations thereof.

Referring to FIGS. 2-8, the club head 22 is shown in greater detail. The club head 22 includes a fore body 24 and an aft body 26. The fore body 24 is a rigid structure that includes a planar front strike face 28, a top surface 30, heel and toe side regions 32 and 34 having heel and toe side walls 36 and 38, respectfully, and a generally planar sole 40. In one preferred embodiment, the fore body 24 is formed of aluminum and the aft body 26 is formed of a stainless steel. In this preferred embodiment, the club head 22 can have a weight of approximately 375 grams, a moment of inertia about a vertical axis $I_{yy}$ of approximately 4410 g-cm$^2$, and a center of gravity positioned at a distance of approximately 42.5 mm from the front strike face 28 and a height of approximately 13 mm from the lower surface of the sole 40.

In another alternative preferred embodiment, the fore body 24 and the aft body are both formed of aluminum. In this preferred embodiment, the club head 22 can have a weight of approximately 226 grams, a moment of inertia about a vertical axis $I_{yy}$ of approximately 2447 g-cm$^2$, and a center of gravity positioned at a distance of approximately 36.4 mm from the front strike face 28 and a height of approximately 11.7 mm from the lower surface of the sole 40. In yet another alternative preferred embodiment, the fore body 24 the aft body 26 can both be formed of a stainless steel. In this preferred embodiment, the club head 22 can have a weight of approximately 688 grams, a moment of inertia about a vertical axis $I_{yy}$ of approximately 7445 g-cm$^2$, and a center of gravity positioned at a distance of approximately 36.4 mm from the front strike face 28 and a height of approximately 11.7 mm from the lower surface of the sole 40. Accordingly, the weight of the club head 22 can be selected from a range of 226 grams to 688 grams, and the moment of inertia of the club head 22 about the axis $I_{yy}$ can be selected from the range of 2447 g-cm$^2$ to 7445 g-cm$^2$.

Figure 7:
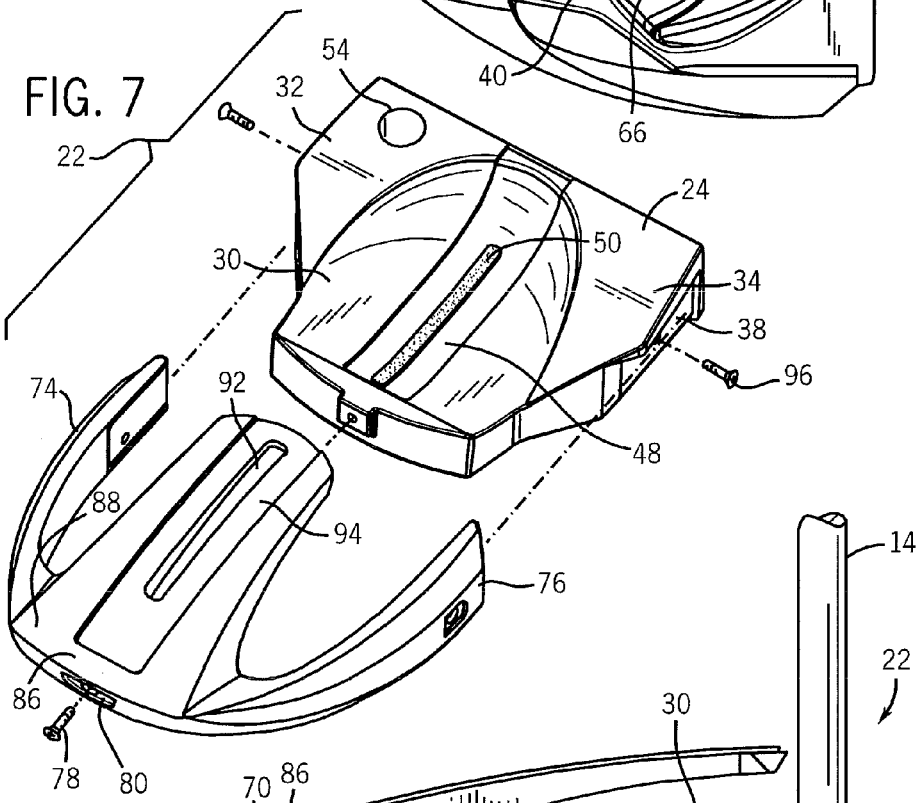
FIG. 7 is an exploded top perspective view of the putter head of FIG. 1

The front strike face 28 is configured for impacting the golf ball. In a preferred embodiment, the strike face 28 is formed as a continuous smooth surface. In alternative preferred embodiments, the strike face can include a textured surface, a plurality of score lines, and combinations thereof. Referring to FIG. 7, in an alternative preferred embodiment, a face recess 42 can be formed into the strike face 28, and an insert 44 can be inserted into the recess 42. The insert 44 is preferably formed of a durable resilient material having a hardness value that is less than the hardness of the strike face 28, such as, for example, a polyurethane. Alternatively, other materials can be used, such as, other elastomeric materials, wood, a ceramic, a thermoset polymeric material, and combinations thereof.

Figure 2:
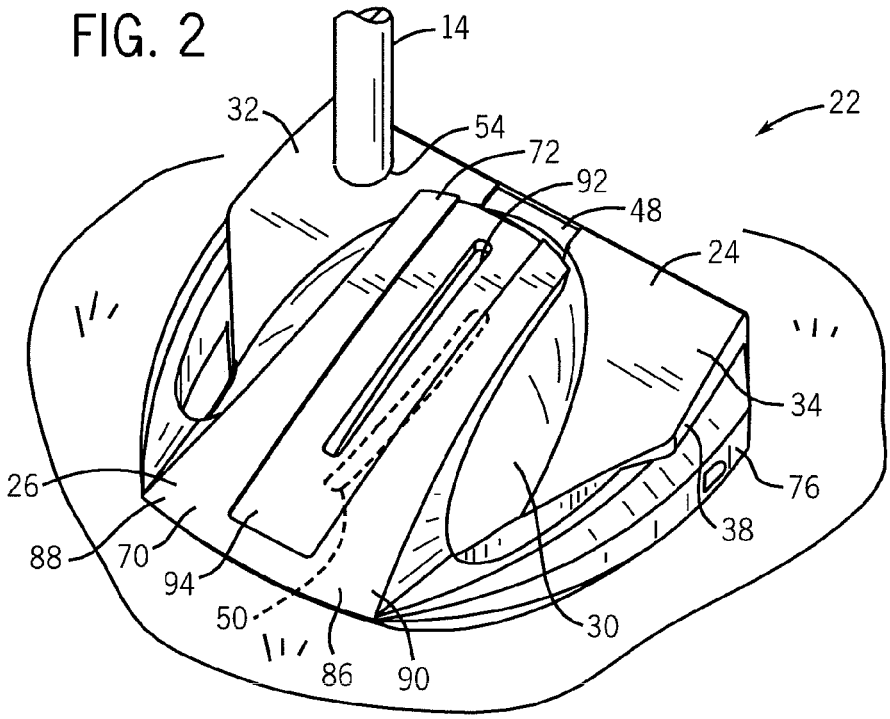
FIG. 2 is a rear, top perspective view of the putter head of FIG. 1.
Figure 3:
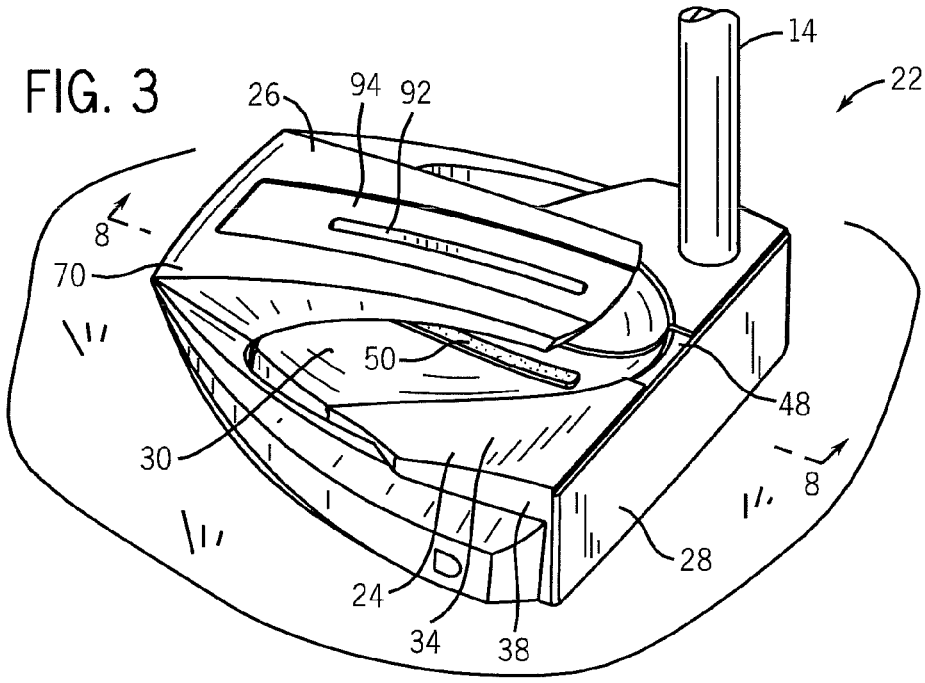
FIG. 3 is a side, top perspective view of the putter head of FIG. 1.
Figure 8:
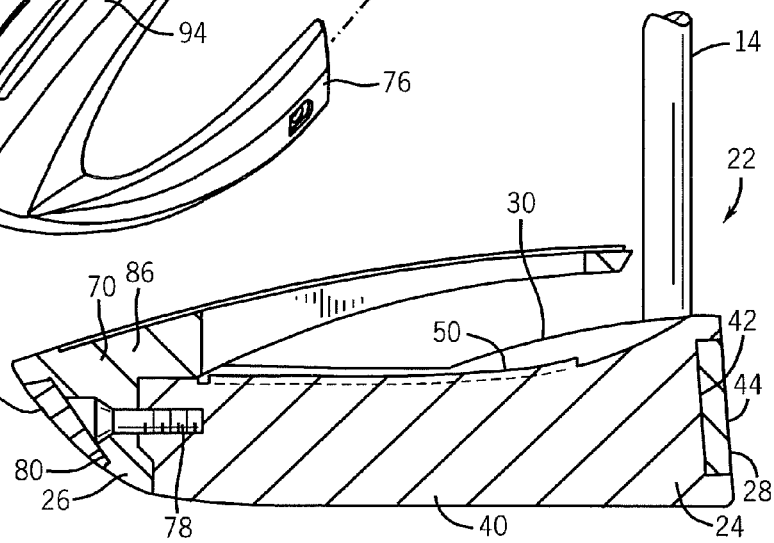
FIG. 8 is a cross-sectional view of putter head taken about line 8-8 of FIG. 3.
Figure 11:
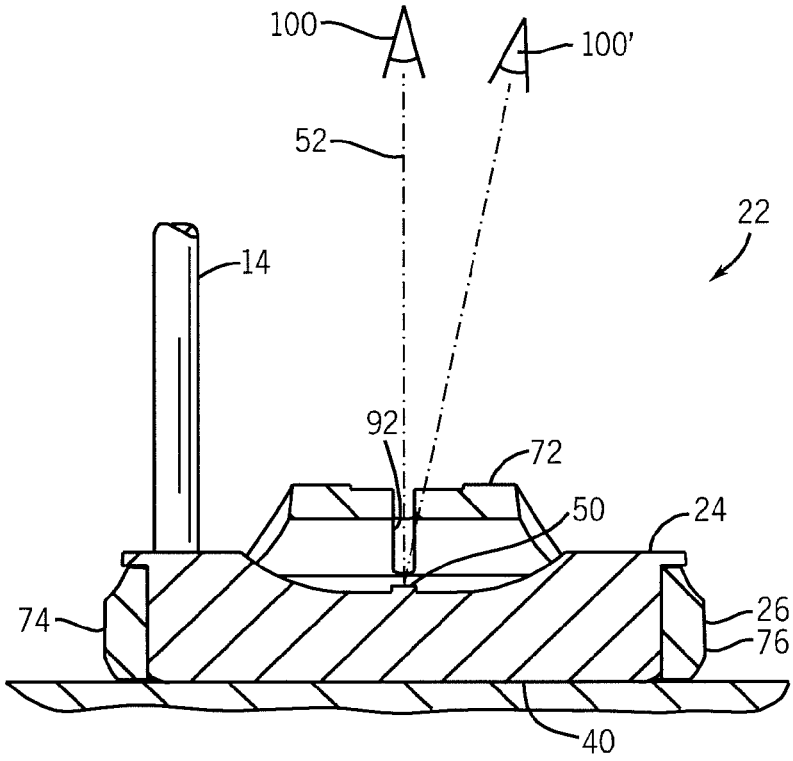
FIG. 11 is a cross-sectional view of the putter head taken about line 11-11 of FIG. 9.

Referring to FIGS. 2, 3 and 7, the top surface 30 of the fore body 24 defines a generally U-shaped main recess 46 and a central groove 48. The main recess 46 slopes down from a location rearward of the strike face 28 and forms a slightly dished or curved region. The central groove 48 extends from the top of the strike face 28 in a direction substantially perpendicular to the planar strike face 28. The central groove 48 provides a widened sightline region on the top surface 30. In one preferred embodiment, the fore body 24 includes a sightline 50 in the top surface 30. Referring to FIGS. 3, 8 and 11, the sightline 50 extends along a first plane 52 (FIG. 11) that is perpendicular to the front strike face 28 and to the sole 40. The sightline 50 is preferably evenly spaced from the heel and toe side walls 36 and 38. The sightline 50 is narrower than the central groove 48, and is preferably positioned in the center of the central groove 48 such that the major dimension of the central groove 48 and the major dimension of the sightline 50 are collinear. The sightline 50 is preferably formed of a first color or a first pattern of one or more colors, and the central groove 48 is preferably formed of a second color pattern, that is different from the first color and the first color pattern, to provide greater contrast to the sightline 50 thereby making it easier to see. Still further, the top surface 30 of the fore body 24 surrounding the central groove 48 can be formed of a third color or a third color pattern that is different from one or both of the first and second colors and the first and second color patterns.

In one particularly preferred embodiment, the sightline 50 is integrally formed with the fore body 24 defining a raised ridge in the top surface 30. In another particularly preferred embodiment, the sightline 50 is a separate strip attached to the top surface 30 of the fore body 24. The sightline 50 can be formed of any durable material. The sightline 50 can be attached to the top surface 30 through use of an adhesive, thermal bonding, chemical bonding, fasteners or combinations thereof. In one preferred embodiment, the sightline 50 has a width of approximately 4 mm and a length of approximately 45 mm. Other dimensions for the length and width of the sightline are also contemplated. The sightline 50 can also be raised with respect to the top surface 30 of the fore body 24 by approximately 2 mm. Other dimensions are also contemplated.

Figure 13:
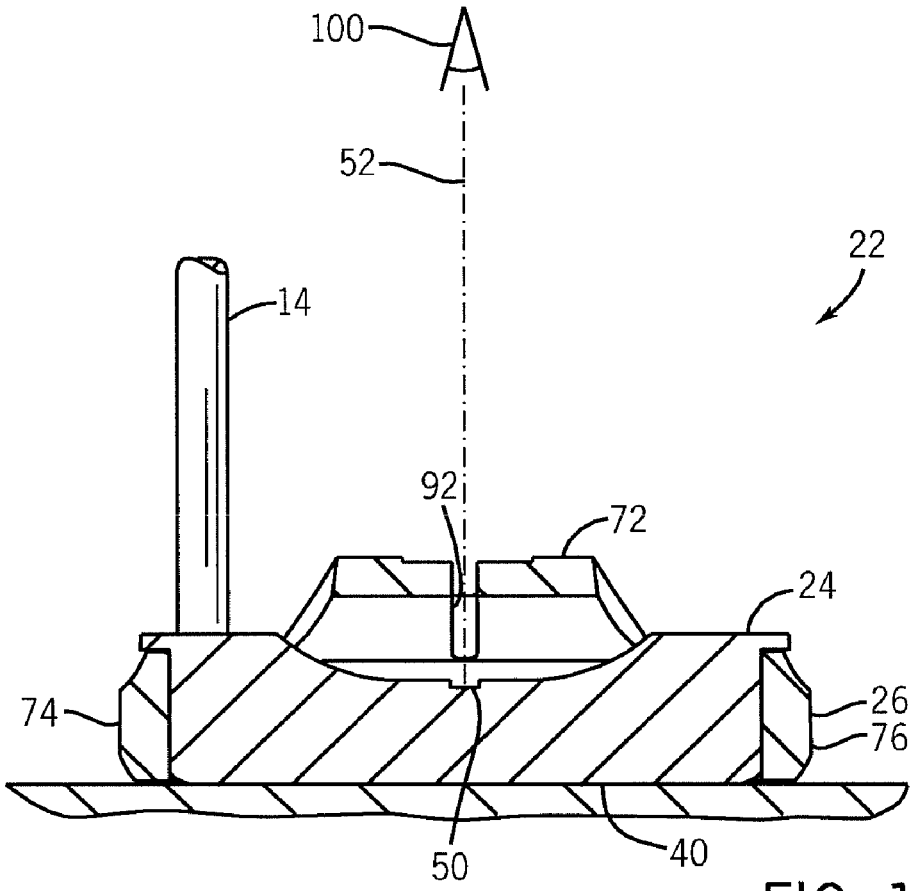
FIG. 13 is a cross-sectional view of the putter head in accordance with an alternative preferred embodiment of the present invention.

Referring to FIG. 13, in another particularly preferred embodiment, the top surface 30 of the fore body 24 defines the sightline 50 as an elongate channel. The depth of the sightline 50 can range from 0 mm to 4 mm, and more preferably, approximately 2 mm. The dimension of the height or depth of the sightline can be zero because the sightline can be a marking or plurality of markings that have generally no measurable height or depth. In other preferred embodiments, the sightline can be a plurality of line segments arranged end to end or a two or more thin parallel lines.

Referring to FIGS. 2 and 7, a generally circular opening 54 is formed in to the top surface 30 of the club head 22 at the heel side region 32. The opening 38 is configured for receiving the tip end 18 of the shaft 14. In alternative preferred embodiment, the shaft can be coupled to the club head through use of an adapter positioned at the opening. In another alternative preferred embodiment, the opening 38 can be removed and the club head can include a projection at the approximate location of the opening for attaching to the tip end of the shaft.

Figure 6:
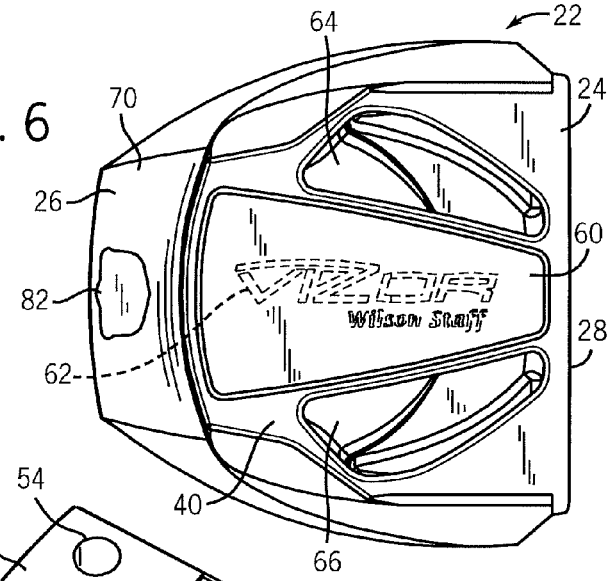
FIG. 6 is a bottom view of the putter head of FIG. 1.

Referring to FIGS. 4, 6 and 8, the substantially planar sole 40, or base, is configured to facilitate the placement of the club head 22 on to a generally horizontal surface, such as a putting green, prior to making a putting stroke. The substantially planar sole 40 facilitates the alignment of the club head 22 behind the ball 12 and the golfer's ability to properly position his or her eyes over the club head as the golfer addresses the ball 12. A central region 60 of the sole 40 can include alpha-numeric and/or graphical indicia 62 representative of a design, a trademark, a feature of the putter, a logo, an image or other design. A plating or other insert can also be attached to the central region 60 of the sole 40. The sole 40 further preferably defines first and second cutouts 64 and 66 positioned on either side of the central region 60. The first and second cutouts 64 and 66 allow for the removal of material from the fore body 24 thereby reducing the overall weight of the fore body 24. The cutouts 64 and 66, in combination with the U-shaped main recess 46, also enable the weight distribution and the mass of the fore body 24 to be greater at the heel and toe side regions 32 and 34. By increasing the mass of fore body 24 at the heel and toe side regions 32 and 34 the relative moment of inertia is optimized for the overall weight of the club head 22. Additionally weight at the heel and toe of the putter 10 increases the putter's moment of inertia thereby making the club head 22 more stable during use.

Referring to FIGS. 2, 3, 7 and 8, the aft body 26 includes a rear main portion 70, an overhang 72 and first and second arms 74 and 76. The aft body 26 is coupled to the fore body 24. Preferably, the aft body 26 coupled to the fore body 24 through a set of three fasteners. In alternative preferred embodiments, the aft body 26 can be connected to the fore body 24 through adhesives, fastener, snap-fit connectors and combinations thereof. Still further, in another alternative preferred embodiment, the aft body 26 can be integrally formed with the fore body 24 as a one-piece structure.

The rear main portion 70 is preferably attached to the rear of the fore body 24 through a fastener 78. A cavity 80 is preferably formed into the rear surface of the rear main portion 70 for receiving the fastener 78. A cover 82 can be placed over the cavity 80 and the fastener 78. The cavity 80 and the cover 82 can be shaped in the shape of a trademark or any geometrical shape. The rear main portion 70 includes a central region 86 positioned between first and second end regions 88 and 90.

The overhang 72 forwardly extends from the central region 86 of the rear main portion 70. The overhang 72 contacts only the rear main portion 70 of the aft body 26 and does not contact the fore body 24. The overhang 72 is a cantilevered alignment aid. With respect to the present invention, the term "cantilevered" means a projecting structure that is fixed at one end and carries a load at its end or along its length, wherein the load can be the weight of the structure itself. The structure is fixed at one end and free or unsupported at the other end. Accordingly, the overhang 72 extends over and is spaced apart from the top surface 30 and the sightline 50 of the fore body 24. The overhang 72 defines an elongate slot 92 extending along the first plane 52 (FIG. 11) and is positioned substantially over the sightline 50. In a preferred embodiment, the overhang 72 is spaced apart from the sightline 50 such that the portion of the overhang 72 defining the slot is spaced apart from the sightline 50 by at least 5 millimeters. In another preferred embodiment, the portion of the overhang 72 defining the slot is spaced apart from the sightline by at least 10 millimeters. The amount of the spacing of the overhang 72 to the sightline 50 can vary over the length of the overhang 72. The slot 92 extends through the overhang 72 enabling the top surface 30 and the sightline 50 to be visible through the slot 92 from a perspective above the overhang 72. The width of the slot 92 preferably at least as wide as the width of the sightline 50. The length of the slot 92 is preferably sized, such that when the club head 22 is positioned on a horizontal surface with the sole contacting the horizontal surface, the slot 92 extends over at least fifty percent of the surface area of the sight line 50. In a particularly preferred embodiment, the slot 92 is sized to extend over at least 80 percent of the surface area of the sight line 50. In another particularly preferred embodiment, the slot 92 is sized to extend over at least 95 percent of the surface area of the sightline 50. The width of the slot 92 is narrower than the width the medial groove 94. In one preferred embodiment, the slot 92 has a width of approximately 4 mm and a length of approximately 45 mm. Other width and length combinations are contemplated. A medial groove 94 is formed into an upper surface 96 of the overhang 72 in a direction substantially perpendicular to the planar strike face 28. The slot 92 is preferably positioned in the center of the medial groove 94 such that the major dimension of the medial groove 94 and the major dimension of the slot 92 are collinear. The medial groove 94 provides a widened sightline region on the upper surface 96 of the overhang 72. The medial groove 94 is preferably formed of the second color or the second color pattern of the central groove 48. In an alternative preferred embodiment, the medial groove 94 can be colored with a color or color pattern that is different from one or more of the first, second and third colors and patterns of colors.

The putter head 22 has a first dimension measured from the front strike face 28 along the first plane 52 (FIG. 11) to the rearmost point of the rear main portion of the aft body 26. The first dimension is preferably within the range of 70 mm to 100 mm. In a particularly preferred embodiment, the first dimension is approximately 85 mm. The overhang 72 projects over the top surface 30 of the fore body 24 by a distance at least as long as 50 percent of the first dimension. The slot 92 also preferably extends over at least 50 percent of the first dimension.

The overhang 72 projects forwardly and upwardly from the rear main portion 70 of the aft body 26 to extend over the top surface 30 of the fore body 24. Preferably, the overhang 72 defines the highest point or portion of the club head 22 when the club head 22 is placed onto a horizontal surface with the sole 40 contacting the horizontal surface. Accordingly, the height of the overhang 72 is greater than the height of the front strike surface 28. Alternatively, the height of the overhang can be even with the height of the front strike face 28. The height of the overhang 72 increases the spacing of the slot 92 from the sightline 50 on the top surface 30 of the fore body 24. The spacing of the slot 92 from the sightline 50 increases the beneficial alignment characteristics of the putter 10 by requiring the golfer's eyes to be directly over the club head 22 in order align the slot 92 with the sightline 50.

The first and second arms 74 and 76 forwardly and outwardly project from the first and second end regions 88 and 90 of the rear main portion 70, respectively. Referring to FIG. 7, the first and second arms 74 and 76 are attached to the heel and toe side regions 32 and 34, respectively, with fasteners 98. A pair of decorative covers 99 (FIG. 5) can be positioned on the first and second arms 74 and 76 over the fasteners 96. The first and second arms 74 and 76 further optimize the weight distribution and balance of the club head 22. The first and second arms 74 and 76 increase the moment of inertia of the club head 22 at the heel and toe regions of the club head making the club head more stable during use.

Figure 9:
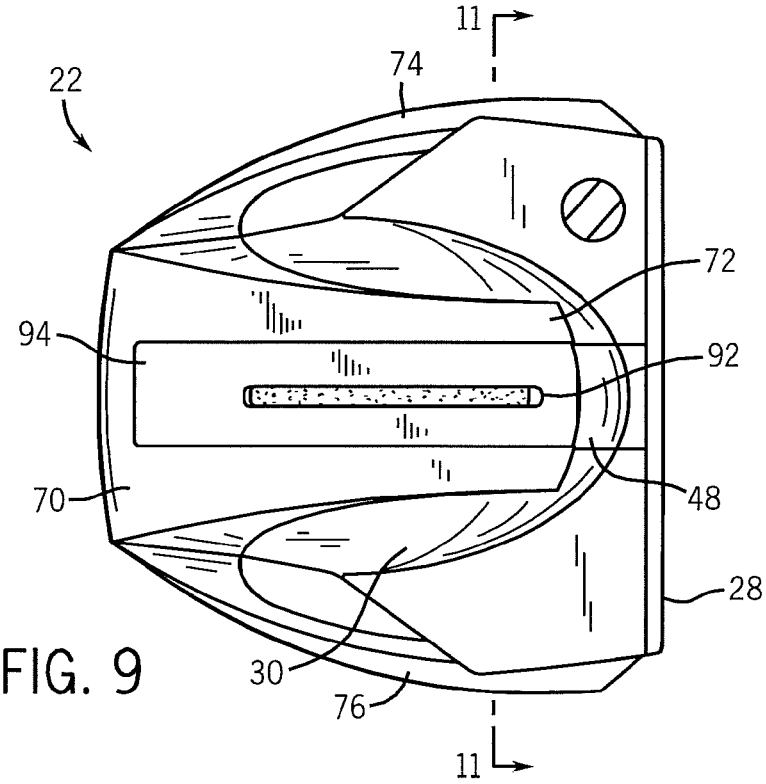
FIG. 9 is a top view of the putter head of FIG. 1.
Figure 10:
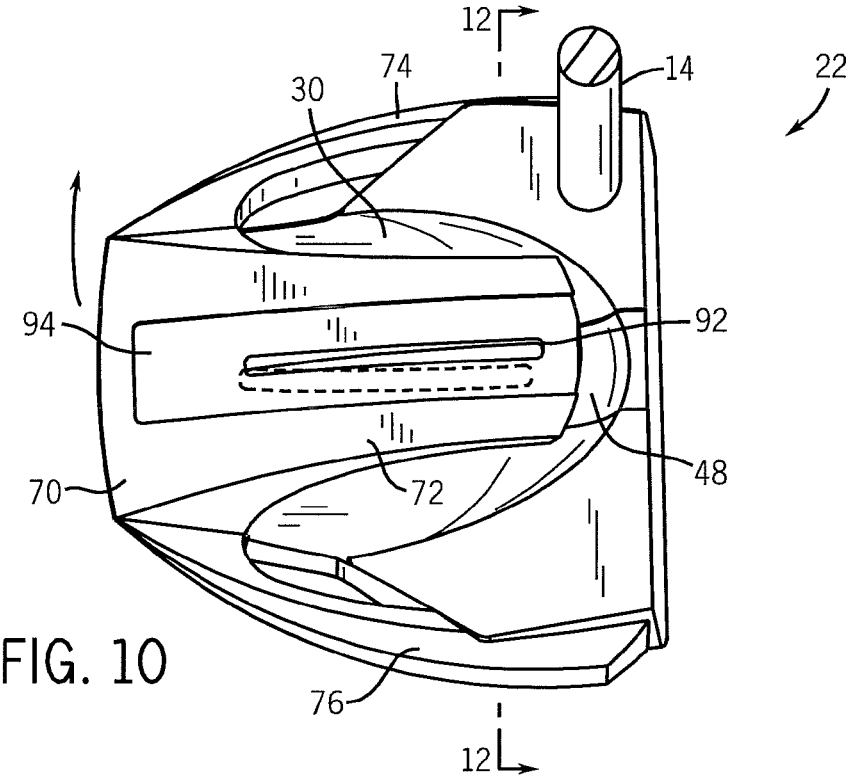
FIG. 10 is a top, side view of the putter head of FIG. 1.

Referring to FIGS. 9-12, the beneficial alignment characteristics of the club head 22 can be seen. Referring to FIG. 9, a top view of the club head 22 is shown. When a golfer places his or her eyes directly over the club head 22 of the putter 10 as generally recommended for consistent, successful putting, the slot 92 is aligned over the sightline 50 and substantially all of the upper surface of the sightline 50 is visible to the golfer. When the golfer can see the sightline 50, as in FIG. 9, he or she can feel confident that his or her eyes are in the proper position over the putter. Referring to FIG. 11, plane 52 is aligned with the sightline of the golfer's eyes 100 and the golfer's eyes 100 are properly positioned directly over the slot 92 and the sightline 50 indicating proper alignment and an alignment angle of 0 degrees. However, if the golfer repositions his or her eyes, such as the eye position designated as 100', the overhang 72 blocks the golfer's view of the sightline 50. The eye position 100' creates an undesirable alignment angle that can result in incorrect alignment and missed putts. The present invention provides instant feedback to the golfer that his or her eyes are mis-positioned over the club head 22 by blocking full view of the sightline 50. FIG. 10 approximates the view of the golfer's eyes when his or her eye position is in eye position 100' of FIG. 11. The slot 50 is not visible, or only partially visible, to the golfer because the overhang 72 blocks the view of the sightline 50 and the slot 92 is not in line with the angle of the golfer's view to the club head 22 and the sightline 50.

Figure 12:
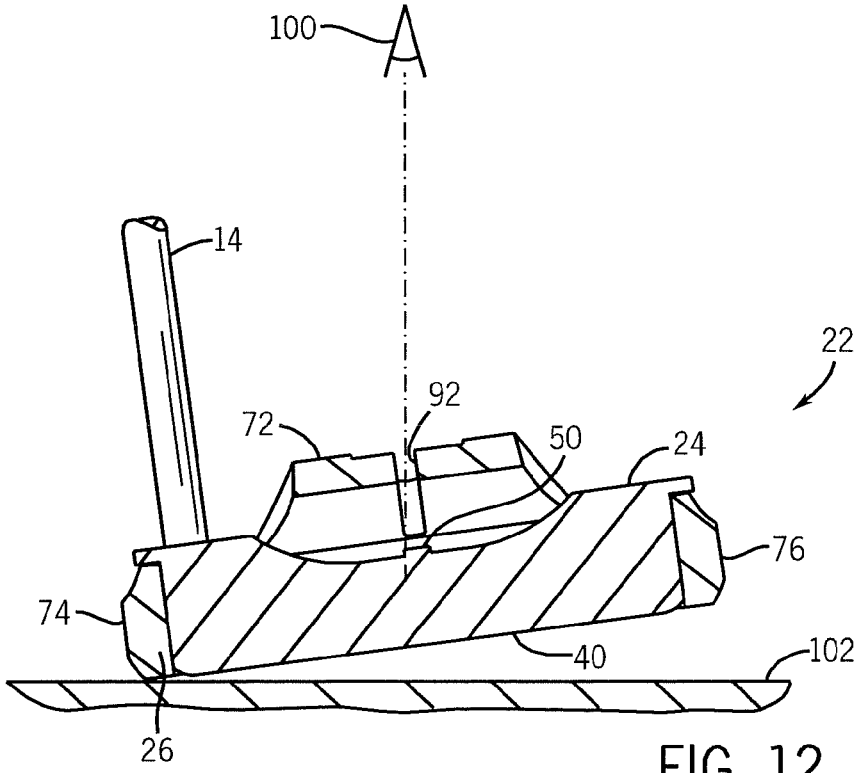
FIG. 12 is a cross-sectional view of the putter head taken about line 12-12 of FIG. 10.

FIGS. 10 and 12 also illustrate the effect of not properly placing or aligning the club head behind the ball. If the club head 22 is cocked or angled with respect to the putting surface 102, the same misalignment feedback is provided to the golfer. The cocked or angled club head 22 causes the slot 92 to become out of alignment with the golfer's eyes 100 and the sightline 50 because the overhang 72 blocks full or proper view of the sightline 50. Accordingly, the present invention provides instant feedback to the golfer that misalignment exists and the golfer can readjust the club head position or his or her eye position to properly align his or her eyes with the slot 92 and the sightline 50.

The club head 22 and the putter 10 of the present invention is also configured for use in competitive play including tournament play by satisfying the requirements of The Rules of Golf as approved by the U.S. Golf Association and the Royal and Ancient Golf Club of St. Andrews, Scotland effective Jan. 1, 2008 ("The Rules of Golf"). Accordingly, the term "putter head is configured for organized, competitive play" refers to a shaft that fully meets the golf shaft rules and/or requirements of The Rules of Golf.

Accordingly, the present invention provides a golf putter 10 with an alignment for assisting the golfer in aligning his or her eyes over the putter and the target line of the putt. The putter 10 that enables a golfer to properly position his or her eyes over the putter and the target line of the ball without requiring instruction and guidance from a teaching professional or other experienced golfers. In fact, the present club head 22 provides instant feedback to the golfer on every putt. The club head 22 provides a valuable tool for the golfer to continually check and calibrate his or her alignment before proceeding with putt and therefore, increases the likelihood of a putt that is on target and successful. The putter 10 of the present invention also provides optimal weight distribution with increases heel and toe weighting for increased moment of inertia thereby reducing the likelihood of a golfer inadvertently shifting or moving the strike face of the putter during the putt stroke. Further, the present invention provides a putter with an improved, engaging aesthetic.

Although the present disclosure has been described with reference to example embodiments, workers skilled in the art will recognize that changes may be made in form and detail without departing from the spirit and scope of the claimed subject matter. Therefore, the present invention is not limited to the foregoing description but only by the scope and spirit of the appended claims.

What is claimed is:

1. A putter head comprising:

a fore body including a planar front strike face, a heel side wall, a toe side wall, a rear wall, a top surface and a generally planar sole, the top surface including a sightline, the sightline extending along a first plane that is perpendicular to the front strike face and to the sole, and substantially evenly spaced from the heel and toe side walls; and an aft body coupled to the fore body and including a rear main portion and an overhang, the rear main portion engaged to the rear wall of the fore body, and having a central region positioned between first and second end regions, the overhang forwardly extending from the central region of the main portion, the overhang including an elongate slot extending along the first plane, and positioned substantially over at least a portion of the sightline, the overhang of the aft body being configured not to contact the fore body.

2. The putter head of claim 1, wherein the putter head has a first dimension measured from the front strike face to the rearmost point of the rear main portion along the first plane.

3. The putter head of claim 2, wherein the slot extends over at least 50% of the first dimension.

4. The putter head of claim 2, wherein the overhang forwardly projects over the fore body by a distance at least as long as 50% of the first dimension.

5. The putter head of claim 1, wherein the sightline is applied to the top surface of the fore body.

6. The putter head of claim 1, wherein the top surface of the fore body includes an elongate recess defining the sightline.

7. The putter head of claim 1, wherein the top surface of the fore body includes an elongate ridge defining the sightline.

8. The putter head of claim 1, wherein the sightline is formed of a first color, and wherein the region of the top surface directly adjacent the sight line is formed of a second color, and wherein the first color is different from the second color.

9. The putter head of claim 1, wherein the width of the sightline and the width of the slot are approximately the same dimension.

10. The putter head of claim 1, wherein the sightline of the fore body is spaced apart from the perimeter of the slot by at least 5 millimeters.

11. The putter head of claim 1 such that when the putter head is placed onto a substantially horizontal surface with the sole contacting the surface, the height of the overhang is greater than or even with the height of the front strike face.

12. The putter head of claim 1, wherein the putter head is configured for organized, competitive play by satisfying the requirements of The Rules of Golf.

13. A putter head comprising:

a fore body including a planar front strike face, a heel side wall, a toe side wall, a rear wall, a top surface and a generally sole, the top surface including a sightline, the sightline extending along a first plane that is perpendicular to the front strike face and to the sole, and substantially evenly spaced from the heel and toe side walls; and an aft body coupled to the fore body and including a rear main portion and an overhang, the rear main portion engaged to the rear wall of the fore body, and having a central region positioned between first and second end regions, the overhang forwardly extending from the central region of the main portion, the overhang including an elongate slot extending along the first plane, and positioned substantially over at least a portion of the sightline, the aft body further including first and second arms forwardly extending from the first and second end regions of the rear base portion, respectively.

14. The putter head of claim 13, wherein the first and second arms engage the heel and toe side walls of the fore body, respectively.

15. The putter head of claim 13, wherein the putter head has a first dimension measured from the front strike face to the rearmost point of the rear main portion along the first plane, and wherein the slot extends over at least 50% of the first dimension.

16. The putter head of claim 13, wherein the putter head has a first dimension measured from the front strike face to the rearmost point of the rear main portion along the first plane, and wherein the overhang forwardly projects over the fore body by a distance at least as long as 50% of the first dimension.

17. The putter head of claim 13, wherein the width of the sightline and the width of the slot are approximately the same dimension.

18. The putter head of claim 13, wherein the sightline of the fore body is spaced apart from the perimeter of the slot by at least 5 millimeters.

19. The putter head of claim 13 such that when the putter head is placed onto a substantially horizontal surface with the sole contacting the surface, the height of the overhang is greater than or even with the height of the front strike face.

20. A putter head configured for placement onto a substantially horizontal surface, the putter head comprising:

a front wall having a planar front strike face;

a rear portion;

a base rearwardly extending from the front wall to the rear portion, the base having a central region and including a sightline; and an overhang forwardly extending from the rear portion and over the central portion of the base toward the front wall, the overhang contacting only the rear portion of the putter head, the overhang including an elongate slot, the slot positioned such that, when the putter head is placed onto the horizontal surface with the base contacting the surface, the slot extends over a majority of the surface area of the sightline.

21. The putter head of claim 20 such that when the putter head is placed onto the horizontal surface with the base contacting the surface, the height of the overhang is greater than, or even with, the height of the front wall.

22. The putter head of claim 20, wherein the base has a substantially planar lower surface, wherein the sightline extends along a first plane that is perpendicular to the front strike face and to the lower surface of the base, and wherein the putter head has a first dimension measured from the front strike face to the rearmost point of the rear portion along the first plane.

23. The putter head of claim 22, wherein the slot extends over at least 50% of the first dimension.

24. The putter head of claim 22, wherein the overhang forwardly projects over the base by a distance at least as long as 50% of the first dimension.

25. The putter head of claim 20, wherein the sightline is applied to the top surface.

26. The putter head of claim 20, wherein the top surface of the base includes an elongate recess defining the sightline.

27. The putter head of claim 20, wherein the top surface of the base includes an elongate ridge defining the sightline.

28. The putter head of claim 20, wherein the sightline is formed of a first pattern including one or more colors, and wherein the region of the top surface directly adjacent the sightline is formed of a second pattern including one or more color, and wherein the first pattern is different from the second pattern.

29. The putter head of claim 20, wherein the width of the sightline and the width of the slot are approximately the same dimension.

30. The putter head of claim 20, wherein the sightline of the fore body is spaced apart from the perimeter of the slot by at least 5 millimeters.

31. The putter head of claim 20, wherein the slot extends over substantially the entire sightline.

* * * * *